US011572218B2

(12) United States Patent
Byrne

(10) Patent No.: US 11,572,218 B2
(45) Date of Patent: Feb. 7, 2023

(54) BLANK AND PAPERBOARD ENVELOPE FORMED THEREFROM

(71) Applicant: Calumet Carton Company, South Holland, IL (US)

(72) Inventor: Robert Dennis Byrne, Cedar Lake, IN (US)

(73) Assignee: Calumet Carton Company, South Holland, IL (US)

( * ) Notice: Subject to any disclaimer, the term of this patent is extended or adjusted under 35 U.S.C. 154(b) by 0 days.

(21) Appl. No.: 17/241,301

(22) Filed: Apr. 27, 2021

(65) Prior Publication Data

US 2021/0331836 A1 Oct. 28, 2021

Related U.S. Application Data

(60) Provisional application No. 63/016,284, filed on Apr. 27, 2020.

(51) Int. Cl.
*B65D 27/34* (2006.01)
*B65D 27/16* (2006.01)

(52) U.S. Cl.
CPC ..... *B65D 27/34* (2013.01); *B65D 27/16* (2013.01)

(58) Field of Classification Search
CPC ..... B65D 27/14; B65D 27/16; B65D 27/34; B65D 27/36
USPC ..... 229/75, 80, 92.1, 302
See application file for complete search history.

(56) References Cited

U.S. PATENT DOCUMENTS

| | | | | | |
|---|---|---|---|---|---|
| 1,299,021 | A * | 4/1919 | Planche | B42D 15/08 | 229/92.1 |
| 1,636,495 | A * | 7/1927 | Widmaier | B42D 5/025 | 493/363 |
| 1,897,602 | A * | 2/1933 | Bayer | B65D 27/00 | 229/75 |
| 2,689,079 | A * | 9/1954 | Timer | B65D 27/005 | 229/72 |
| 3,125,279 | A | 3/1964 | Watts et al. | | |
| 3,666,926 | A * | 5/1972 | Conte, Jr. | G06K 19/02 | 235/487 |
| 3,968,927 | A * | 7/1976 | Katz | B42D 15/08 | 229/70 |
| 4,313,557 | A * | 2/1982 | Foffel | B65D 27/00 | 229/301 |
| 4,406,647 | A * | 9/1983 | Foffel | B65D 27/00 | 493/216 |
| 2005/0186420 | A1* | 8/2005 | Black | B42D 15/08 | 428/346 |

(Continued)

*Primary Examiner* — Jes F Pascua
(74) *Attorney, Agent, or Firm* — Cook Alex Ltd.

(57) ABSTRACT

A blank including a single rectangular sheet of paperboard having opposed top and bottom edges and opposed left and right edges. The sheet has a midline spaced equally from the left and right edges, with a cut that extends from the top edge to a point spaced from the top edge, and a fold line that extends from the point to the bottom edge. The sheet also has a first zone that extends from midline to right edge along the bottom edge, a second zone that extends from bottom edge to a line spaced from the top edge along the right edge, a third zone that extends from midline to left edge along the bottom edge, and a fourth zone that extends from bottom edge to the line along the left edge. The first and second zones are configured to join the third and fourth zones.

18 Claims, 2 Drawing Sheets

(56) References Cited

U.S. PATENT DOCUMENTS

2014/0117072 A1* 5/2014 Cullen ..... B65D 25/2873
229/117.05

* cited by examiner

BLANK AND PAPERBOARD ENVELOPE FORMED THEREFROM

This application claims the benefit of U.S. Provisional Patent application No. 63/016,284, filed Apr. 27, 2020, which application is hereby incorporated by reference herein.

BACKGROUND

This patent is directed to a blank for a paperboard envelope and a paperboard envelope formed therefrom.

SUMMARY

According to an aspect, a blank for forming a paperboard envelope is provided, the blank including a single rectangular sheet of paperboard having opposed top and bottom edges and opposed left and right edges. The sheet has a midline spaced equally from the left and right edges. The midline incudes a cut that extends from the top edge to a point spaced from the top edge, and a fold line that extends from the point to the bottom edge. The sheet also has a first zone that extends from the midline to the right edge along the bottom edge, a second zone that extends from the bottom edge to a line spaced from the top edge, the line parallel to the top and bottom edges and disposed through the point, along the right edge, a third zone that extends from the midline to the left edge along the bottom edge, and a fourth zone that extends from the bottom edge to the line along the left edge. The first and second zones are configured to join the third and fourth zones, respectively, with the blank folded about the fold line.

According to a further aspect, a paperboard envelope is formed from a blank including a single rectangular sheet of paperboard having opposed top and bottom edges and opposed left and right edges. The sheet has a midline spaced equally from the left and right edges. The midline incudes a cut that extends from the top edge to a point spaced from the top edge, and a fold line that extends from the point to the bottom edge. The sheet also has a first zone that extends from the midline to the right edge along the bottom edge, a second zone that extends from the bottom edge to a line spaced from the top edge, the line parallel to the top and bottom edges and disposed through the point, along the right edge, a third zone that extends from the midline to the left edge along the bottom edge, and a fourth zone that extends from the bottom edge to the line along the left edge. The first and second zones are configured to join the third and fourth zones, respectively, with the blank folded about the fold line.

DETAILED DESCRIPTION OF VARIOUS EMBODIMENTS

Figure 1:
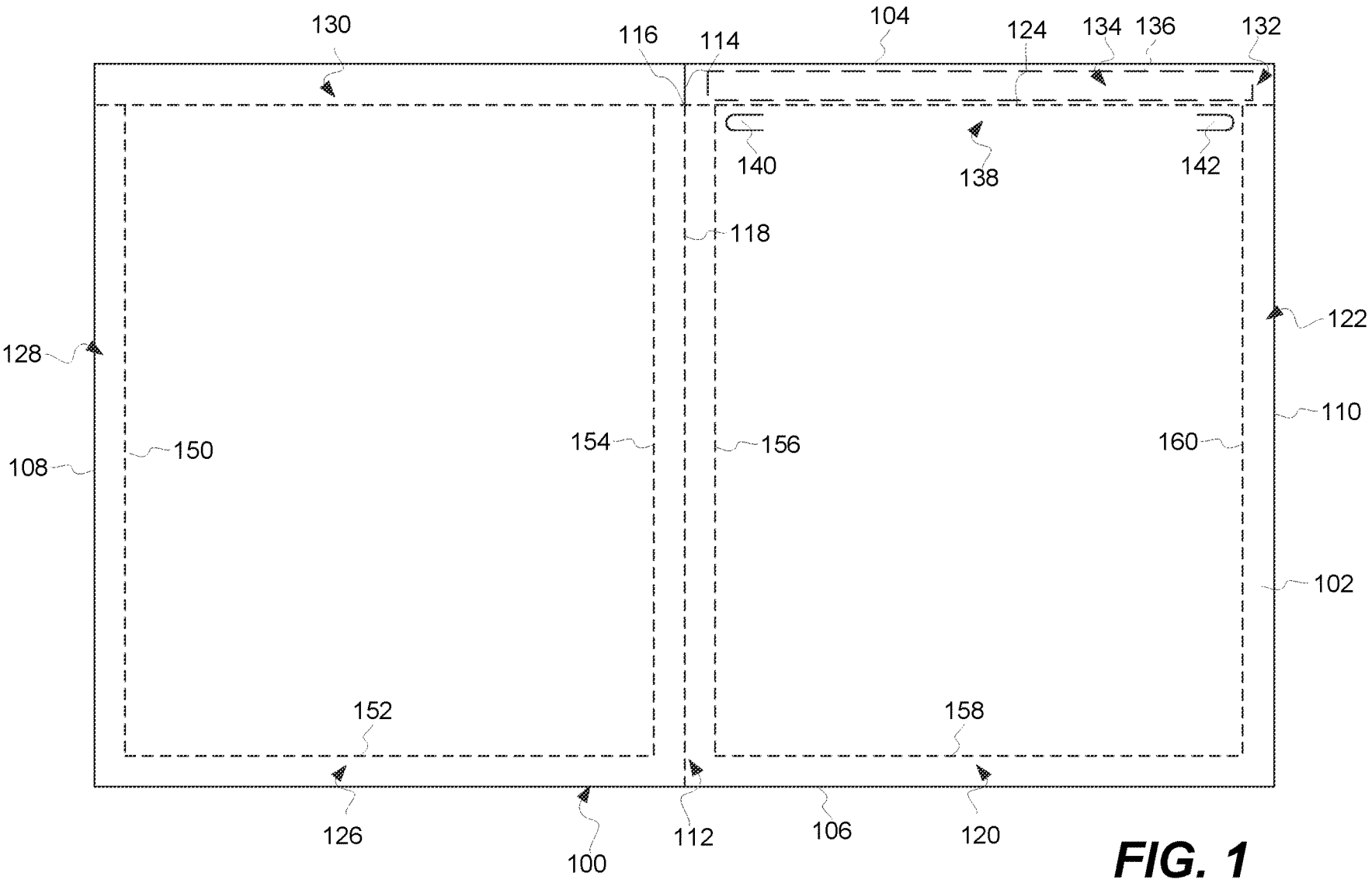
FIG. 1 is a plan view of a blank used to form a paperboard envelope.
Figure 3:
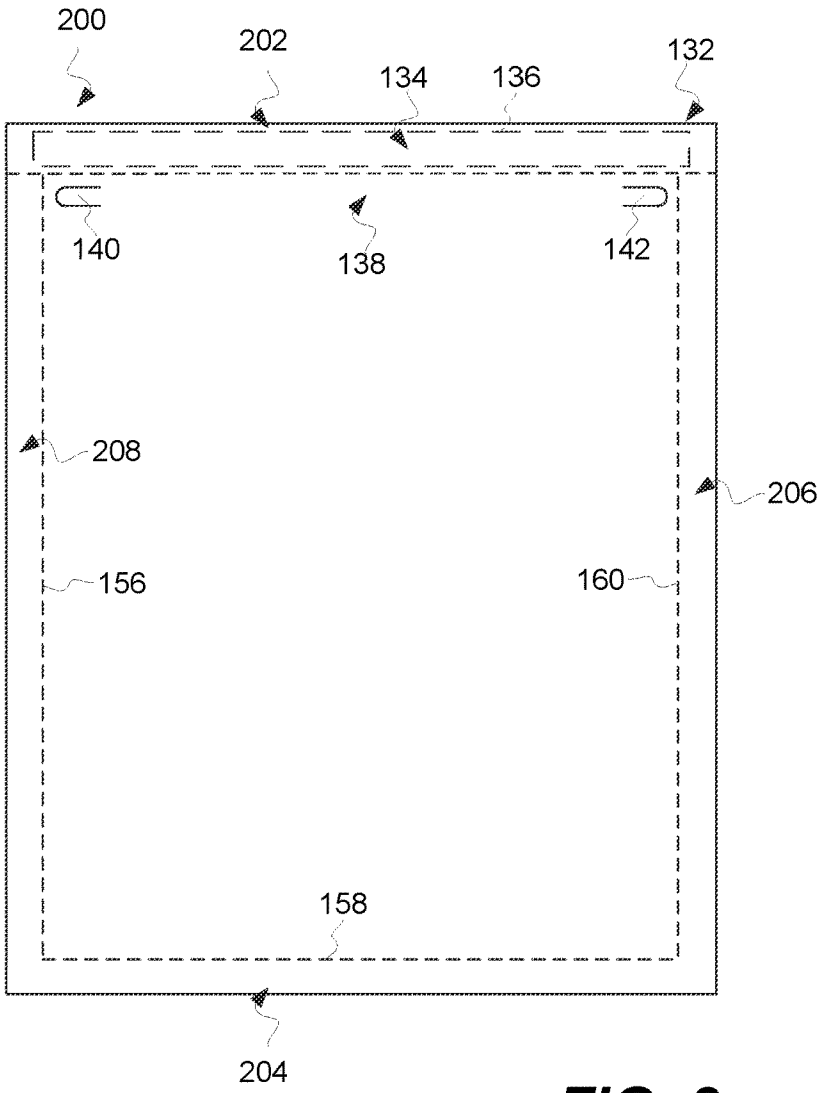
FIG. 3 is a back view of the paperboard envelope formed from the blank of FIG. 1.
Figure 2:
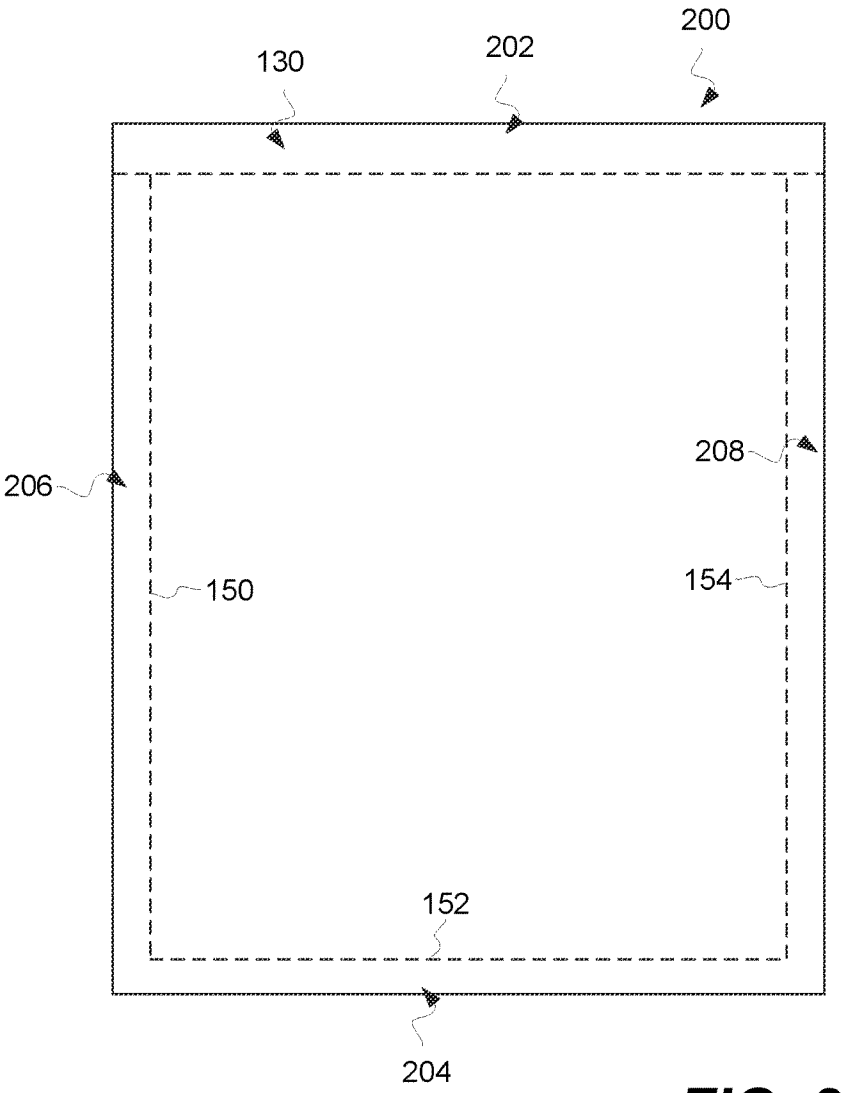
FIG. 2 is a front view of the paperboard envelope formed from the blank of FIG. 1.

FIG. 1 illustrates a blank 100 for forming a paperboard envelope according to the disclosed embodiments. The blank 100 can be used to form a paperboard envelope 200, such as illustrated in FIGS. 2 and 3.

The blank 100 includes a single rectangular sheet 102 of paperboard having opposed top and bottom edges 104, 106 and opposed left and right edges 108, 110. The sheet 102 has a midline 112 spaced equally from the left and right edges 108, 110, and parallel to the left and right edges 108, 110. The midline 112 incudes a cut 114 that extends from the top edge 104 to a point 116 spaced from the top edge 104 (e.g., about 1 inch (2.5 cm) from the top edge 104), and a fold line 118 that extends from the point 116 to the bottom edge 106.

The sheet 102 also has a first zone 120 that extends from the midline 112 to the right edge 110 along the bottom edge 106, a second zone 122 that extends from the bottom edge 106 to a line 124 spaced from the top edge 104 along the right edge 110, a third zone 126 that extends from the midline 112 to the left edge 108 along the bottom edge 106, and a fourth zone 128 that extends from the bottom edge 106 to the line 124 along the left edge 108. The line 124 is parallel to the top and bottom edges 104, 106 and disposed through the point 116. The first and second zones 120, 122 are configured to join the third and fourth zones 126, 128, respectively, with the blank 100 folded about the fold line 118.

During assembly, the blank 100 may be folded about the fold line 118, such that the first zone 120 overlies the third zone 126 and the second zone 122 overlies the fourth zone 128. The first and third zones 120, 126 then may be joined together, as may the second and fourth zones 122, 128, to form the envelope 200. With the first and third zones 120, 126 and second and fourth zones 122, 128 secured, the regions of between the top edge 104 and the line 124 may be left unsecured to permit an article or articles (e.g., an item of apparel, such as a shirt or sweater) to be introduced into the envelope 200. A fastener may be associated with these regions to permit the envelope 200 to be closed after the article or articles has/have been disposed within the envelope 200.

Having thus described the blank 100 and the method of assembling the blank 100 into the envelope 200, further details are described about the blank 100 and the envelope 200 with reference to FIGS. 1-3.

Referring first to FIG. 1, the blank 100 includes a rectangular sheet 102 of paperboard, as mentioned above. As such, the top edge 104 is parallel to the bottom edge 106, and the left edge 108 is parallel to the right edge 110. According to certain embodiments, the distance from the top edge 104 to the bottom edge 106 is 17.5 inches (43.75 cm), and the distance from the left edge 18 to the right edge 110 is 28.5 inches (71.25 cm). According to such embodiments, the sheet of paperboard may be an uncoated, recycled, TBC grade of paperboard, with a thickness of 0.015 inches (0.381 mm). According to other embodiments, the dimensions may differ, and the grade and thickness of paperboard may differ.

The top, bottom, left and right edges 104, 106, 108, 110 are free of tabs or extensions: that is, there are no sections of the rectangular sheet 102 that have been removed to form the blank 100, such as might have been removed to form trapezoidal or other shaped regions depending from any of the top, bottom, left, and right edges 104, 106, 108, 110. An advantage of this structure is that there is no material waste in forming the blank, such as might arise from forming the blank with tabs or extensions along one or more of the edges 104, 106, 108, 110. There is also a savings in processing time and cost related to the elimination of steps to form such tabs or extensions.

As was also mentioned previously, the first and second zones 120, 122 are configured to be joined to the third and fourth zones 126, 128. According to one embodiment, the first and second zones 120, 122 may be configured to be joined to the third and fourth zones 126, 128 by disposing an adhesive on the first and second zones 120, 122, while the third and fourth zones 126, 128 are left clear. Alternatively, the first and second zones 120, 122 may be configured by leaving these zones clear, and disposing the adhesive in the third and fourth zones 126, 128. According to other embodiments, adhesive may be disposed in all four zones. The adhesive may be a formulated synthetic resin emulsion adhesive.

It will be recognized that the zones, for example first and third zones 120, 126 and second and fourth zones 122, 128, may be joined and secured to each other in such a fashion that the interface between the zones does not have large gaps. It is preferred that the zones be joined in such a fashion that the interfaces are substantially uniform, such that the first and third zones 120, 126 and second and fourth zones 122, 128 are joined and secured completely (i.e., without any gaps) along almost the entire length of their interfaces. For example, the zones may be joined and secured completely along at least 90%, 95% or 100% of their length.

The joined and secured zones 120, 122, 126, 128 and the midline 112 define an interior space of the envelope 200 along three sides of that space. The fourth side is defined by two opposing flaps 130, 132. Each flap 130, 132 is defined between one of the left and right edges 108, 110 and the midline 112, and in particular the cut 114. The flaps 130, 132 may be joined using a fastener provided for the user to join and secure the flaps 130, 132 to each other.

For example, a fifth zone 134 may be defined that extends from the midline 112 to the right edge 110 along the top edge 104. An adhesive may be disposed in the fifth zone 134, and a release liner 136 may be disposed over the adhesive in the fifth zone 134. When the liner 136 is removed, the adhesive is exposed and can be used to seal the envelope 200 in a closed state. Such a structure may be referred to conventionally as a peel-and-seal fastener or closure, although other types of self-seal fasteners or closures may be used. The adhesive may be a pressure-sensitive adhesive, such as a pressure sensitive hot-melt adhesive.

In addition, the blank 100 may also include a mechanism for opening the envelope 200 formed using the blank 100 without resort to scissors or the like. For example, the blank 100 may include a tear strip 138 disposed between the line 124 and the bottom edge 106, the tear strip 138 having a first end 140 spaced from the midline 112 and a second end 142 spaced from the right edge 110. The first and second ends 140, 142 may be cut through or scored into the sheet 102 in such a way that the user may grasp one of the ends 140, 142 and tear an opening through the sheet 102 to permit articles to be removed from the formed envelope 200. The tear strip 138 may have a region of reinforcement to guide the tear through the sheet 102, such as might be provided by a strip of reinforcing material disposed on and joined to (e.g., adhered to) a surface of the sheet 102 between the first and second ends 140, 142.

The blank 100 may also have one or more lines spaced inwardly from the left edge 108, the bottom edge 106, and the right edge 110, the lines being scored or grooved. As illustrated, there are lines 150, 152, 154, 156, 158, 160 spaced from the bottom, left, and right edges 106, 108, 110, as well as the midline 112. For example, the lines may be spaced from the edges 106, 108, 110 and the midline 112 by 0.75 inches (1.875 cm). The lines 150, 152, 154 may be connected, as may the lines 156, 158, 160. According to certain embodiments, these lines may have a mechanical function, but according to other embodiments, the lines are included purely for decoration.

FIGS. 2 and 3 illustrate the envelope 200 formed using the blank of FIG. 1. Certain features of the blank 100, such as the flaps 130, 132, the peal-and-seal fastener 134, 136 and the tear strip 138 are labeled in FIGS. 2 and 3, as are the lines 150, 152, 154, 156, 158, 160.

As illustrated, the envelope 200 has opposing ends 202, 204 and opposing sides 206, 208. The end 202 includes the flaps 130, 132, while the opposed end 204 is formed by the joined and secured first and third zones 120, 126. The side 206 is formed by the joined and secured second and fourth zones 122, 128, while the side 208 is formed at the fold line 118 when the blank 100 is folded about the fold line 118. The envelope 200 has an interior space that is defined on three sides by the end 204 and the sides 206, 208 and on a fourth side selectively by the end 202 with flaps 130, 132. When formed, before an article or articles are disposed in the envelope 200, the envelope 200 is empty and flat.

As noted above, the flaps 130, 132 may be joined and secured using, for example, the peal-and-seal fastener 134, 136 to prevent an article from being removed from the interior space. On the other hand, the tear strip 138 may be used to form an opening in a wall of the envelope to permit the article to be removed from the interior space. As such, the envelope permits a user to selectively close and open the envelope 200 without other equipment or supplies (e.g., glue, scissors, etc.).

Although the preceding text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

What is claimed is:

1. A blank for forming a paperboard envelope, the blank comprising:

a single rectangular sheet of paperboard, having opposed top and bottom edges and opposed left and right edges, the sheet having a midline spaced equally from the left and right edges, the midline comprising a cut that extends from the top edge to a point spaced from the top edge, the cut extending a distance from the top edge to the point that is less than a seventeenth of a distance from the top edge to the bottom edge, and a fold line that extends from the point to the bottom edge, and the sheet having a first zone that extends from the midline to the right edge along the bottom edge, a second zone that extends from the bottom edge to a line spaced from the top edge, the line parallel to the top and bottom edges and disposed through the point, along the right edge, a third zone that extends from the midline to the left edge along the bottom edge, and a fourth zone that extends from the bottom edge to the line along the left edge, the first and second zones being configured to join the third and fourth zones, respectively, with the blank folded about the fold line; and an adhesive disposed in a fifth zone that extends from the midline to the right edge along the top edge, and a release liner disposed over the adhesive in the fifth zone.

2. The blank according to claim 1, further comprising an adhesive disposed in the first and second zones.

3. The blank according to claim 1, wherein the adhesive is a pressure-sensitive adhesive.

4. The blank according to claim 1, further comprising a tear strip disposed between the line and the bottom edge, the tear strip having a first end spaced from the midline and a second end spaced from the right edge.

5. The blank according to claim 1, further comprising at least one line spaced inwardly from the left edge, the bottom edge, and the right edge, the at least one line being scored or grooved.

6. An envelope formed from a blank according to claim 1.

7. A blank for forming a paperboard envelope, the blank comprising:

a single rectangular sheet of paperboard, having opposed top and bottom edges and opposed left and right edges, the sheet having a midline spaced equally from the left and right edges, the midline comprising a cut that extends from the top edge to a point spaced from the top edge, the cut extending a distance from the top edge to the point that is less than a seventeenth of a distance from the top edge to the bottom edge, and a fold line that extends from the point to the bottom edge, and the sheet having a first zone that extends from the midline to the right edge along the bottom edge, a second zone that extends from the bottom edge to a line spaced from the top edge, the line parallel to the top and bottom edges and disposed through the point, along the right edge, a third zone that extends from the midline to the left edge along the bottom edge, and a fourth zone that extends from the bottom edge to the line along the left edge, the first and second zones being configured to join the third and fourth zones, respectively, with the blank folded about the fold line, and a tear strip disposed between the line and the bottom edge, the tear strip having a first end spaced from the midline and a second end spaced from the right edge.

8. The blank according to claim 7, further comprising an adhesive disposed in the first and second zones.

9. The blank according to claim 7, further comprising an adhesive disposed in a fifth zone that extends from the midline to the right edge along the top edge, and a release liner disposed over the adhesive in the fifth zone.

10. The blank according to claim 9, wherein the adhesive is a pressure-sensitive adhesive.

11. The blank according to claim 7, further comprising at least one line spaced inwardly from the left edge, the bottom edge, and the right edge, the at least one line being scored or grooved.

12. An envelope formed from a blank according to claim 7.

13. A blank for forming a paperboard envelope, the blank comprising:

a single rectangular sheet of paperboard, having opposed top and bottom edges and opposed left and right edges, the sheet having a midline spaced equally from the left and right edges, the midline comprising a cut that extends from the top edge to a point spaced from the top edge, the cut extending a distance from the top edge to the point that is less than a seventeenth of a distance from the top edge to the bottom edge, and a fold line that extends from the point to the bottom edge, and the sheet having a first zone that extends from the midline to the right edge along the bottom edge, a second zone that extends from the bottom edge to a line spaced from the top edge, the line parallel to the top and bottom edges and disposed through the point, along the right edge, a third zone that extends from the midline to the left edge along the bottom edge, and a fourth zone that extends from the bottom edge to the line along the left edge, the first and second zones being configured to join the third and fourth zones, respectively, with the blank folded about the fold line; and at least one line spaced inwardly from the left edge, the bottom edge, and the right edge, the at least one line being scored or grooved.

14. The blank according to claim 13, further comprising an adhesive disposed in the first and second zones.

15. The blank according to claim 13, further comprising an adhesive disposed in a fifth zone that extends from the midline to the right edge along the top edge, and a release liner disposed over the adhesive in the fifth zone.

16. The blank according to claim 15, wherein the adhesive is a pressure-sensitive adhesive.

17. The blank according to claim 13, further comprising a tear strip disposed between the line and the bottom edge, the tear strip having a first end spaced from the midline and a second end spaced from the right edge.

18. An envelope formed from a blank according to claim 13.

* * * * *